US007231873B2

(12) United States Patent
Macchi

(10) Patent No.: US 7,231,873 B2
(45) Date of Patent: Jun. 19, 2007

(54) PRINT CAROUSEL FOR DOUBLE TECHNOLOGY SILK-SCREEN AND DIGITAL COLOR PRINTING

(75) Inventor: Luigi Macchi, Gallarate (IT)

(73) Assignee: Colorprint Di Macchi L. & C. S.N.C., Gallarate (IT)

( * ) Notice: Subject to any disclaimer, the term of this patent is extended or adjusted under 35 U.S.C. 154(b) by 0 days.

(21) Appl. No.: 11/439,186

(22) Filed: May 24, 2006

(65) Prior Publication Data

US 2006/0266232 A1 Nov. 30, 2006

(30) Foreign Application Priority Data

May 27, 2005 (EP) ..... 05425373

(51) Int. Cl.
*B41F 15/12* (2006.01)
*B41F 17/38* (2006.01)
*B41F 15/10* (2006.01)

(52) U.S. Cl. ..... 101/115; 101/126; 101/114

(58) Field of Classification Search ..... 101/114, 101/115, 123, 126, 129, 474; 347/2; *B41F 17/38, B41F 15/10, 15/12, 15/18*
See application file for complete search history.

(56) References Cited

U.S. PATENT DOCUMENTS 6,262,808 B1 7/2001 Hermann
6,397,740 B1 * 6/2002 Dubuit ..... 101/141
2004/0187715 A1 9/2004 Niimi
2005/0140715 A1 * 6/2005 Manoukian ..... 347/20
2006/0162586 A1 * 7/2006 Fresener et al. ..... 101/115
2006/0207448 A1 * 9/2006 Fresener et al. ..... 101/115
2006/0249039 A1 * 11/2006 Feldman et al. ..... 101/115

* cited by examiner

*Primary Examiner*—Leslie J. Evanisko
(74) *Attorney, Agent, or Firm*—Connolly Bove Lodge & Hutz LLP

(57) ABSTRACT

A print carousel for color images having a plurality of radial arms carrying objects to be printed incrementally reaching a corresponding number of work stations by sequential incremental rotation of the carousel by a certain angle, a silk-screen printing ink-pot functionally installed in several of said work stations alternately to work stations of drying/polymerization of respective silk-screen printing ink or paste applied in the work station precedingly reached by the object to be printed, has at least one of said work station equipped with a supporting structure for a color digital plotter mounted on slides running on radially oriented guides, from an outermost limit position to an innermost limit position. The radial arms have means for radially shifting the object to be printed from a first retracted position of crossing of said work stations equipped with the silk-screen printing ink-pots to a radially extended out second position, commanded upon reaching said digital color printing work station equipped with said plotter. Also provided is a double-technology print process.

4 Claims, 3 Drawing Sheets

PRINT CAROUSEL FOR DOUBLE TECHNOLOGY SILK-SCREEN AND DIGITAL COLOR PRINTING

This application claims priority from European Application 05425373.7, filed May 27, 2005.

TECHNICAL FIELD

The present invention relates to techniques of color printing graphical compositions on manufactured clothing articles, textiles, textile or rigid panels and similar printable materials.

BACKGROUND ART

The development of digital printing technologies by color plotters on textiles, leather, leather imitations, wood and alike materials, has made possible the printing of any kind of reproducible subject, whether an author's picture, a drawing, a logo or even a color photograph with a very high definition and chromatic rendition, through the acquisition of a digital image file from a scanner or from a source file or alike, an eventual graphical processing by common application programs for optimizing the driving of a color printing plotter. Moreover, digital printing is usable, within certain limits, even in presence of reliefs and/or depressions and may therefore be used even on manufactured clothing articles, in which hems, pockets, or sewings may be present in the area to be printed.

By contrast, it is practically impossible to digitally print by a common inkjet plotter color graphical compositions on dark or black supports. Another limitation of digital printing is the impossibility of forming features in relief or of introducing special effects such as for example: glitters, glues, expanded materials, in order to obtain peculiar esthetical effects in the drawing or graphical image to be reproduced on the printable support.

The traditional silk-screen printing of textiles and other supports has well-known limitations of resolution and chromatic rendering, having to reconcile these requirements with the use of a reasonable maximum number of silk-screen printing stencils needed for the sequential application of as many silk-screen printing inks or pastes, each application needing a drying step.

However, differently from digital printing, the traditional silk-screen printing technique permits the use of special inks or pigmented pastes and therefore the printing may be done on any surface even black without any problem. Moreover, glitters, glues, expanding materials may be included in the paste in order to produce special effects and decor features of the graphical composition been printed.

On a different account, the silk-screen printing technique barely tolerates the presence on the printing area of reliefs and/or depressions as may be produced by the presence of sewing lines, hems, pockets and the like in the printing area.

Notwithstanding the fact that for large quantities of articles to be printed with the same graphical composition, the silk-screen printing may yet be more economical than digital printing using an inkjet plotter, screen printing is burdened by problems and costs relating to the large amounts of waste it generates, such as waste fabrics, solvents, cleaning materials and above all by the large quantities of water that are consumed for washing with consequent costs of disposal, being classified as "special" waste because it contains dissolved or suspended metals, pigments, solvents and resins.

SUMMARY OF THE INVENTION

Vis-à-vis with these peculiarities of the digital color printing systems and of the silk-screen printing systems, the applicants have found an outstandingly effective complementarity or synergy of the two distinct printing technologies in overcoming, in a very efficient manner, respective limitations and drawbacks in a novel combined process of color printing and implementing carousel by the use of which it is possible to print color graphical compositions through a combination of silk-screen printing steps and of digital printing steps, using an inkjet plotter, with outstandingly high productivity and cost efficiency.

The combining in a unified printing process of the two printing technologies achieves a significative saving in the production costs compared to an entirely silk-screen printing process, as would otherwise be dictated if special effects, typically not realizable with a digital color printing are required.

In terms of reduction of production costs, the advantages become more and more significant with a reduction of the number of pieces to be printed and only for an extremely large number of pieces; the double-technology process of the present applicants may show a cost per unit comparable to that of a production by silk-screen printing alone.

Even in these cases, the combined process digital/silk-screen printing and the printing carousel of the present invention remains of great utility during the phase of sample production, necessary for preparing a series of samples for evaluating different print results on the clothing articles or supports, in order to optimize the color graphical composition to be reproduced, eventually by a wholly silk-screen printing process in very large quantities. Print samples, to verify the expected results can be rapidly produced at relatively low costs by availing, for what pertains to the portion of the color image (free of effects to be exclusively obtainable by screen printing) of the possibility to print it by a plotter, without having to realize a large number of test stencils, during such a preliminary phase of adjusting the reproduction of the color graphical image on the articles.

The combined double technology printing process of the applicants includes the following steps:

1. acquiring an image from a scanner, file or other source;
2. optional graphical processing by an image processing application software;
3. decomposing and selecting one or more complementary printing frames of the image, attributing them a certain hue for producing relative masks for fabricating respective silk-screen printing stencils;
4. loading the processed image on a PC suitable to driving a color plotter;
5. positioning the article to be printed on an appropriate frame or support;
6. optionally pre-treating the print area by using a background silk-screen printing stencil, for example forming a light tonality (white) background on the print area of an otherwise black or dark article to be printed or priming the print area by chemical etch or precision aerography and drying/polymerization of a pigmented ink applied through the stencil;
7. printing said processed digital color image by the color plotter over said print area;
8. optionally carrying out one or more silk-screen printing steps for realizing effects implementable exclusively via screen-printing, using relative stencils and pastes and drying/polymerizing the applied ink or paste.

According to the present invention, all the steps of the combined process are executed in a semi-automatic or fully automatic fashion without removing the article being printed from the respective holding frame of a print carousel on which is loaded and from which is unloaded at the end of the whole combined double technology printing process.

Of course, instead of with a rotating carousel, the process may also be performed on an equivalent sequential linear print machine of same or comparable capabilities in terms of the number of work stations available.

According to a particularly efficient embodiment, the novel double technology print carousel is able to produce prints of high chromatic definition by virtue of the use of a digital printing stage by a color plotter as well as the ability of realizing special features via silk-screen printing, with an encumbrance and manpower requirements that are outstandingly reduced compared to the normal requirements of a silk-screen printing process of comparable chromatic rendering.

The invention is defined in the annexed claims.

Still other objects and advantages of the present disclosure will become readily apparent by those skilled in the art from the following detailed description, wherein it is shown and described only in the preferred embodiments, simply by way of illustration of the best mode. As will be realized, the disclosure is capable of other and different embodiments, and its several details are capable of modifications in various obvious respects, without departing from the disclosure. Accordingly, the description is to be regarded as illustrative in nature and not as restrictive.

DESCRIPTION OF BEST AND VARIOUS MODES

Figure 1:
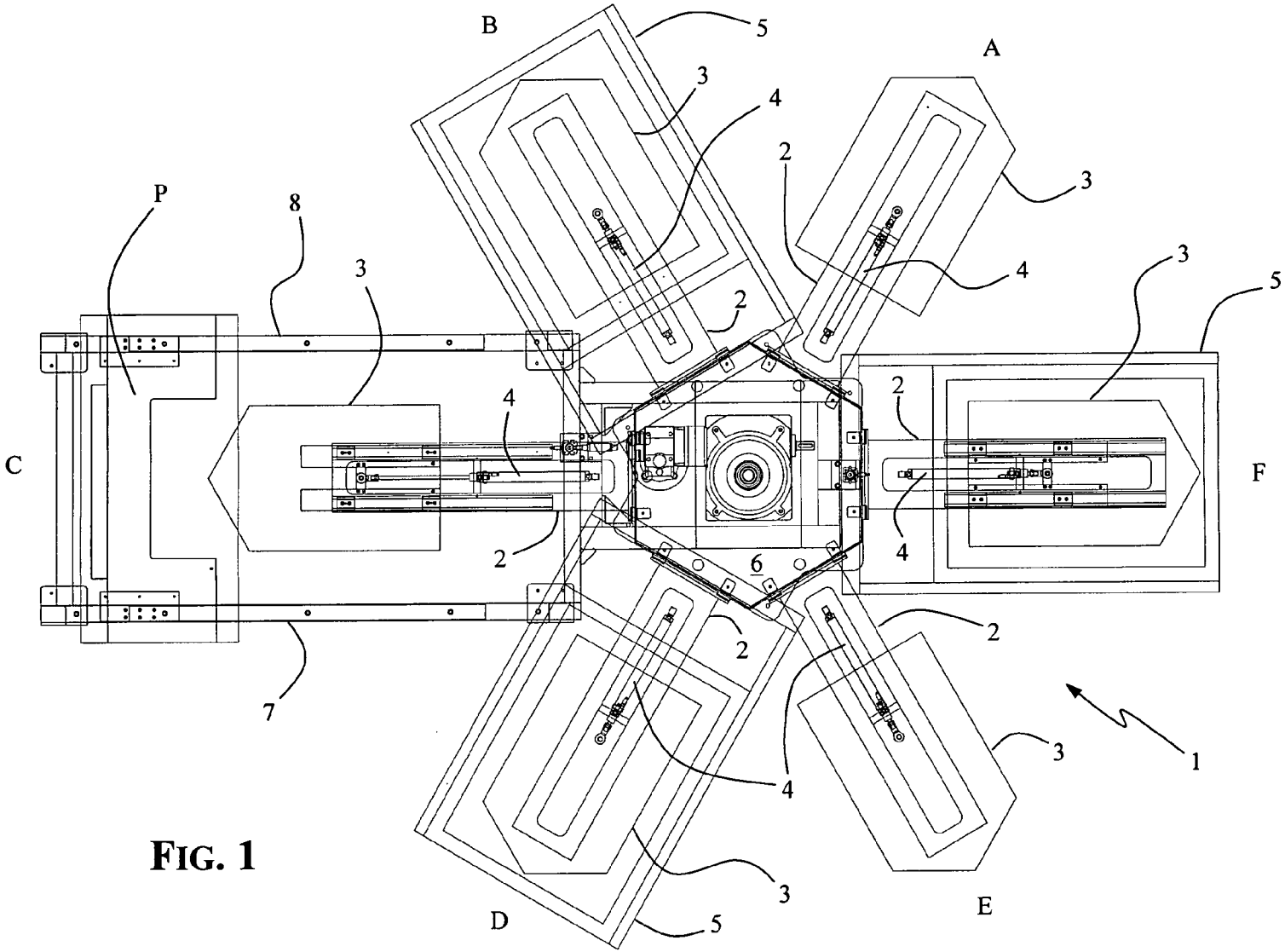
FIG. 1 is a plain view of a print carousel according to the present invention.

With reference to the figures, according to the embodiment shown for purely illustrative purpose, the carousel, indicated as a whole with 1, has six stations, namely: A, B, C, D, E and F that are reached by sequential incremental rotations by about 60° of the carousel.

The carousel 1 has six radial arms 2 carrying as many articles to be printed. In the shown example, each arm 2 has a frame 3 on which, for example a clothing article such as a T-shirt, pullover, shirt, vest, jacket or similar textile articles may be mounted.

Each radial arm 2 is equipped with a pneumatic cylinder 4, that may be commanded for radially shifting the frame 3, on which the article to be printed is mounted, from a retracted position to an extended (reach-out) position, by sliding along guides defined in the arm 2.

In the embodiment shown, the stations B, D and F are equipped with a silk-screen printing ink or paste holding plate or ink-pot 5, in which is installed the relative silk-screen printing stencil. Commonly, the ink-pots 5 that are loaded with the proper ink or paste, are pivotally mounted on respective sides of a fixed (hexagonal) bench 6 of the carousel and held in an inclined stand-by position, to be eventually lowered on the article to be printed for releasing the ink, for example upon moving a "doctor blade" across the surface of the stencil.

Figure 2:
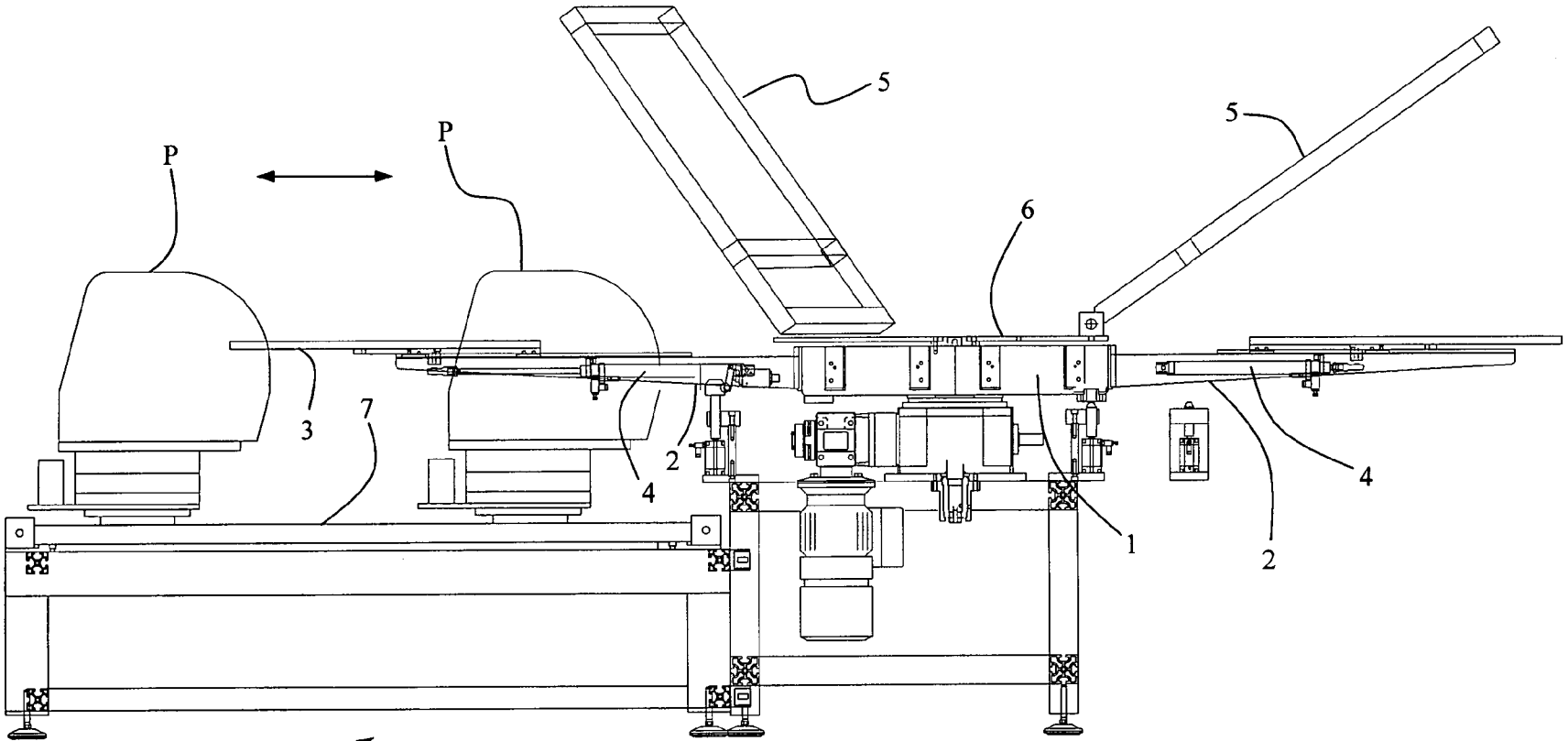
FIGS. 2 and 3 are elevation views of the print carousel.
Figure 3:
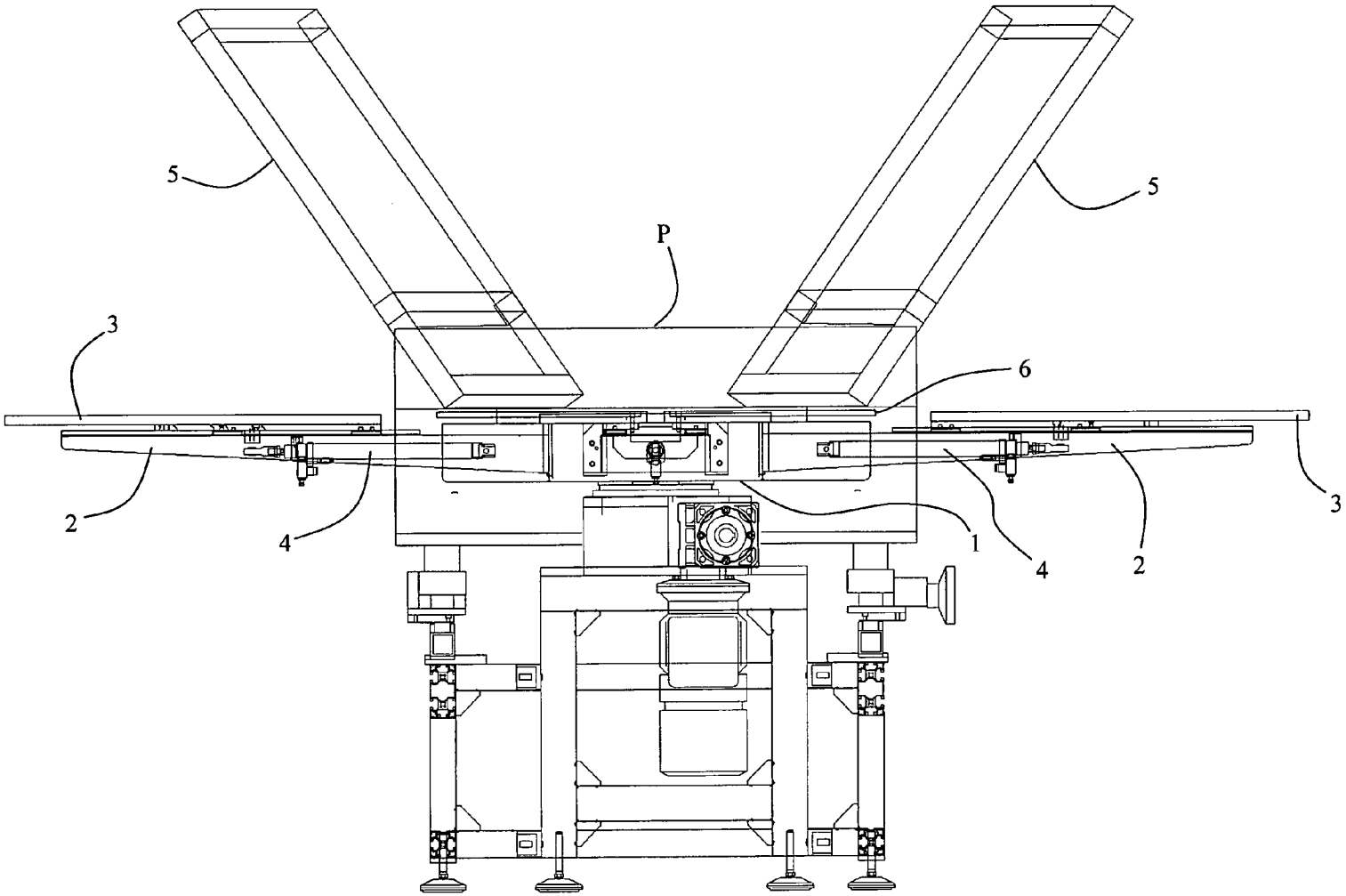

The station C is equipped with a support and radial guiding structure of a color plotter P for digital printing, as better observable in the elevation view of FIG. 2.

The supporting structure 6 defines a radial track formed by the guide rails 7 and 8, along which the plotter P travels, advancing and retracting radially to and from the two limit positions, indicated in the elevation view of FIG. 2 by duplicating the profile of the radially traveling plotter P.

Upon reaching the digital printing station C, the frame, carrying the article to be printed, sustained by the respective radial arm 2 of the carousel, is moved radially out by commanding the extension of the control cylinder 4.

Having thus shifted out the frame carrying the article to be printed, the digital color printing is performed by the plotter P that incrementally moves over the whole print area of the article, reaching eventually the innermost limit position without interfering with the silk-screen printing ink-pots of the two adjacent stations B and D of the carousel.

At the end of the printing, the plotter P returns to the outermost position, the cylinder 4 of the shiftable frame 3 retracts to its normal position and the carousel rotates by 60°, bringing the article just printed by the plotter to the station D, where the relative silk-screen printing ink-pot may be equipped with a stencil patterned in a way as to define the areas of certain features of the graphical composition, such as for example features with glitters or to be realized in relief or for other visual effects that cannot be produced by digital color printing.

According to the embodiment shown, the print carousel of this invention permits to carry out as many as (three) silk-screen printing steps, sequentially before and/or after the digital color printing step carried out by the plotter P in the station C of the machine.

For example, by assuming an anti-clockwise rotation of the carousel and station A as the loading and unloading station of the articles, the station B, the first to be reached, may be used for example to apply a pigmented background of light tonality over the print area of the graphical motive of relatively dark or black articles if needed, by silk-screen printing, thus permitting digital printing of the image with the color plotter P even on black or dark tonality textile articles.

On the print area so pre-treated in station C, after having dried/polymerized the screen-printed background applied in the preceding station B, the digital printing of the color image is carried out by the plotter P.

In the successive station D may be defined certain special features, for example created by employing a screen-printing paste containing glitters or other decorative materials over defined areas of the image.

After drying/polymerization step carried out in station E, other special features, for example details in relief, may be defined in the successive silk-screen printing station F, using for example an expandable additive that will expand during the successive hot drying treatment or optionally during a post treatment, purposely conducted in an oven.

In any case, once the final drying/polymerization is completed, the printed article is unloaded at the same station A.

Of course other combinations of sequential steps are possible.

A comparative study has been conducted to verify printing costs in case of an exclusively silk-screen printing and in case of a combined, double technology, printing process using the print carousel of the present invention.

The comparison conditions were the following:

Image size: 25×35 cm.

Number of colors: 8

Screen-printing ink used: water base pigmented fluid
Number of articles: 100

| COST ITEM | DIGITAL/ SILK-SCREEN PRINTING | SILK-SCREEN PRINTING |
|---|---|---|
| COST OF INKS | 135.00 €/KG<br>2.16 €/MQ<br>0.20 €/Article (digital) +<br>0.026 €/Article (silk-screen) | 1.291 €/KG<br>PREPARED 8 KG (50 gr)<br>0.11 €/Article |
| AMORTMENT COST | 55,000 € in 3 years<br>4 hours printing/day<br>160 Article/day<br>0.48 €/Article | 0 |
| COST OF ELEC-TRICITY | 1.8 KWH<br>0.00088 €/Article | 4 KWH<br>0.00294 €/Article |
| MANPOWER | 1 operator × 2 hours<br>at 16.00 €/H<br>0.32 €/Article | 1 operator × 3 hours<br>at 16.00 €/H<br>0.48 €/Article |
| STENCILS | 2 stencils for 2 effects<br>(glitter and relief)<br>80.00 € | 8 stencils<br>50 × 70 55 yarns<br>at 40.00 €/stencil<br>320.00 € |
| MAIN-TENANCE | 15%<br>0.274 €/Article | 15%<br>0.57 €/Article |
| TOTAL | 2.10 €/Article | 4.37 €/Article |

In the comparison was not taken into account any amortment cost for the whole silk-screen printing case, assuming it as already completed.

The maintenance costs item included the costs relative to the volume of wastes, of cleaning water, of solvents and of other cleaning materials and of the costs of disposal (that are almost quadruple in case of printing exclusively by silk-screen printing technique).

The advantages afforded by the double technology process of the present invention would increase considerably in case of a request of producing several chromatic versions of the same graphical composition.

This application claims priority from European Patent application No. 05425373.7, entire disclosure of which is incorporated herein by reference.

The foregoing description illustrates and describes the present disclosure. Additionally, the disclosure shows and describes only the preferred embodiments of the disclosure, but, as mentioned above, it is to be understood that it is capable of changes or modifications within the scope of the concept as expressed herein, commensurate with the above teachings and/or skill or knowledge of the relevant art. The embodiments described hereinabove are further intended to explain best modes known of practicing the invention and to enable others skilled in the art to utilize the disclosure in such, or other, embodiments and with the various modifications required by the particular applications or uses disclosed herein. Accordingly, the description is not intended to limit the invention to the form disclosed herein. Also, it is intended that the appended claims be construed to include alternative embodiments.

All publications, patents and patent applications cited in this specification are herein incorporated by reference, and for any and all purposes, as if each individual publication, patent or patent application were specifically and individually indicates to be incorporated by reference. In the case of inconsistencies, the present disclosure will prevail.

The invention claimed is:

1. A print carousel for color images comprising a plurality of radial arms for carrying objects to be printed incrementally reaching a corresponding number of work stations by sequential incremental rotation of the carousel by a certain angle, a silk-screen printing ink-pot functionally installed in several of said work stations alternately to work stations of drying/polymerization of respective silk-screen printing ink or paste applied in the work station precedingly reached by the object to be printed, and wherein at least one of said work stations has a supporting structure for a color digital plotter mounted on slides running on radially oriented guides of said supporting structure, from an outermost limit position to an innermost limit position; and said radial arms having means for radially shifting the object to be printed from a first retracted position of crossing of said work stations equipped with said silk-screen printing ink-pots to a radially extended out second position, commanded upon reaching said work station equipped with said color digital plotter.

2. The print carousel according to claim 1, wherein each of said radial arms has a pneumatic cylinder commanded for radially shifting said object to be printed along a radial guide of said arm.

3. The print carousel according to claim 2, which further comprises the object to be printed and wherein the object to be printed is a manufactured clothing article mounted on a frame that is shiftable along said radial guide by commanding the extension of said pneumatic cylinder.

4. The print carousel according to claim 1, which comprises six distinct work stations, sequentially reached by said object carrying arms through incremental rotations by about 60°, three work stations of which are equipped with said silk-screen printing ink-pot.

* * * * *